United States Patent [19]

Takemura et al.

[11] 4,387,356

[45] Jun. 7, 1983

[54] CIRCUIT BREAKER

[75] Inventors: Kunio Takemura; Hideya Kondo; Akira Yoshio, all of Osaka, Japan

[73] Assignee: Matsushita Electric Works, Ltd., Osaka, Japan

[21] Appl. No.: 237,597

[22] Filed: Feb. 24, 1981

[30] Foreign Application Priority Data

Feb. 29, 1980 [JP] Japan ..... 55-27198

[51] Int. Cl.[3] ..... H01H 75/00

[52] U.S. Cl. ..... 335/6; 335/21; 335/26

[58] Field of Search ..... 335/6, 21, 26, 38, 170, 335/174, 191, 202

[56] References Cited

U.S. PATENT DOCUMENTS 4,056,797 11/1977 Rys ..... 335/6

4,097,830 6/1978 Rys ..... 335/21

4,222,019 9/1980 Rusch ..... 335/6

*Primary Examiner*—George Harris

*Attorney, Agent, or Firm*—Burns, Doane, Swecker & Mathis

[57] ABSTRACT

A circuit breaker wherein one or two of circuit-breaking electric element blocks respectively including current source side and load side terminals, fixed and movable contactors, means for forcibly tripping the movable contactor away from the fixed contactor by operating at least electromagnetically responsive to an overcurrent and an arc suppressing means, and movably supporting the movable contactor at a stationary part of the tripping means is arranged in each of side spaces within a single housing, while a single mechanical contact operating mechanism for moving the movable contactor in each of the blocks between both positions of opening and closing contacts responsive to an external operating force and operatively connected with the tripping means of the blocks is contained in an intermediate space provided between the side spaces, in each of the latter of which the movable contactor of an elongated member is arranged with one end having the movable contact directed toward the source side terminal and with the other supported end directed toward the load side terminal, the arc suppressing means is arranged on the side of the source side terminal and the tripping means is arranged on the side of the load side terminal remote farthest from the arc suppressing means.

10 Claims, 16 Drawing Figures

CIRCUIT BREAKER

This invention relates to circuit breakers and, more particularly, to improvements in a device inserted in a circuit between a current source and a load to break the circuit in response to any overcurrent generated in the load.

In conventional devices of the kind referred to, there is required for each of a desired number of poles an assembly of a circuit-breaking electric element block mainly comprising fixed and movable contactors, means connected between the movable contactor and a load side terminal for forcibly tripping the movable contactor from the position of closing the poles with the fixed contactor upon an arrival of any overcurrent and means arranged as desired adjacent fixed and movable contacts of the both contactors for suppressing an arc generated at the time of the opening operation and of a mechanical contact operating mechanism operatively connecting between such operating member as a handle, push button or the like and the movable contactor for moving the movable contactor between its both pole opening and closing positions in response to pole opening and closing operations of the operating member, locking the contactor in the respective positions and releasing the locking of the movable contactor in the pole closing position in cooperation with the tripping operation of the tripping means. Generally, each of such assemblies is housed in one housing so that, when a plurality of poles are desired, as many assemblies as the desired poles respectively separately contained in the housing are combined with one another to form one circuit breaker. In such case, as a function of the circuit breaker, it is required that the tripping operation in any one of the thus combined assemblies should be simultaneously and positively transmitted to the other assembly or assemblies to open all of the poles. However, as this tripping operation is transmitted through the operating member and contact operating mechanism provided in each assembly separately from those in another assembly, in view of the fact that the number of component parts of each contact operating mechanism is comparatively high, it is practically rather difficult to elevate the simultaneity of the tripping operation in respect of the design and manufacture. In addition, as the contact operating mechanism and operating member are required in each assembly, there are such defects that at least the size of the entire circuit breaker is large, it is difficult to meet the requirement of making it small, the number of parts is high, the manufacture is complicated and the manufacturing costs are hard to reduce.

Further, among the overcurrents to which the tripping means should respond, there are a short-circuited current accompanying a short-circuiting accident in the load and an overload current when an overload is caused to occur. Particularly, it is generally advantageous to use a plunger type electromagnetic tripping device which is high in the immediate response to the former and a bimetal type thermally operated tripping means requiring some operating time for the latter. As a device performing an intermediate function, there is used a dash-pot type electromagnetic tripping device. In order to obtain a breaker which can respond to either of short-circuit and overload overcurrents with sufficient characteristics, it is desirable to use in combination both of the plunger type electromagnetic tripping device and bimetal type thermally operated tripping device. However, in the case of forming one breaker of a plurality of assemblies as described above, the respective elements in each assembly must be efficiently arranged within each housing of the minimum housing space for restricting the entire size of the breaker and, on the other hand, the electric elements and mechanical elements must be separated from each other while such elements and arc suppressing means must be also separated from each other. In all the cases of the operation by any type of the tripping means, further, considerations must be given to that any contact fusing should be prevented by rendering the pole opening speed of the movable contactor high enough, and that, particularly in the case of the plunger type electromagnetic tripping means, the current value of the short-circuit responsive operation should fluctuates with any arrangement in which the axial direction of the plunger is caused to vary depending on the breaker fitting posture resulting in that the timing and speed of the pole opening operation are influenced and also the breaking characteristics fluctuate. Further, in the case of using the two types of tripping devices, the respective tripping means must be connected at a high efficiency to the movable contactor and to the contact operating mechanism in each assembly while being related to each other and, at the same time, the foregoing requirements must be met as far as possible. On the other hand, for all of the ordinary pole opening and closing operations and overcurrent responding operations, there have been restrictions that the movable contactor must be coupled directly to the contact operating mechanism of mechanical elements and, therefore, the tripping means also must be arranged adjacent the contact operating mechanism. Accordingly, a great deal of considerations must be paid in designing the circuit breaker of all overcurrent responding type whereas, due to the foregoing various requirements, practically achievable effect with any arrangement has been extremely restrictive.

Dimensions of the circuit breaker are, further, generally determined by qualities and sizes of the respective circuit-breaking elements to which desired electric capacity and production costs of the breaker are determinative, the quality of insulative material of the housing selected depending on the capacity, the manner in which the respective components are arranged, and so on. However, in order to have the breaker provided with the maximum responding range to the respective short-circuited overcurrent and overload current in the same capacity, two kinds of the tripping means are required as described above and, therefore, it has been very difficult to attain it within the same size in relation to the other component elements. In other words, it can be said to have been very difficult in the conventional arrangement of the circuit breaker to elevate the capacity of the breaker and to expand the responsive tripping range with the same dimensions.

The present invention has been suggested to eliminate the foregoing defects of the conventional circuit breakers.

A primary object of the present invention is, therefore, to provide a circuit breaker in which the assembly for the respective poles as well as the entire arrangement are simplified so as to be easy to manufacture, and which is still high in the breaking characteristics.

Another object of the present invention is to provide a circuit breaker which is high in the breaking characteristics and is still easy to minimize in size.

Another related object of the present invention is to provide a circuit breaker wherein the arrangement specifically of the mechanical contact operating mechanism is simple and can be perfectly separated from other electric elements so as to obtain breaking characteristics high in the reliability.

Still further related object of the present invention is to provide a circuit breaker of which the breaking characteristics do not fluctuate depending on its fitting posture when used.

Still another object of the present invention is to provide a circuit breaker having a structure in which any influence on the component elements of the arc generated at the time of the tripping operation can be minimized.

Other objects and advantages of the present invention will become clear upon reading the following explanation of the invention detailed with reference to preferred embodiments shown in accompanying drawings, in which.

Figure 1:
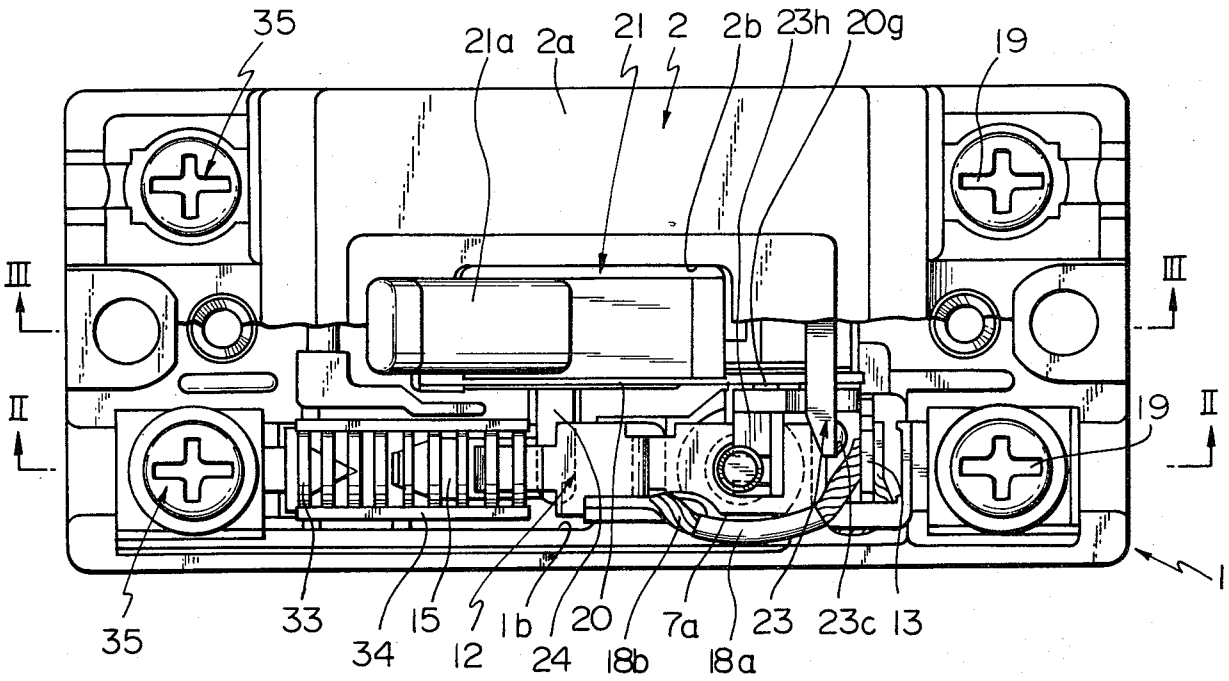
FIG. 1 is a plan view showing a circuit breaker in an embodiment of the present invention with a part of a cover removed.

While the present invention shall now be set forth in the followings with reference to the embodiments shown in the drawings, the intention is not to limit the invention to the particular illustrated embodiments but is rather to include all alterations, modifications and equivalent arrangements possible within the scope of appended claims.

Referring to an embodiment of a circuit breaker according to the present invention with reference to FIGS. 1 to 10, this embodiment is adapted to a use with two poles and is provided with two circuit breaking element blocks. The contact opening and closing operations of each block is made by a single contact operating mechanism located intermediate between the both blocks as a main aspect of the present invention.

A substantially rectangular housing for housing therein these two circuit breaking element blocks and the single contact operating block as separated from each other and comprising a base 1 and cover 2 respectively made of a molding of an insulative material defines, therefore, the side spaces disposed substantially parallelly with each other for housing the respective circuit breaking element blocks and an intermediate space located intermediate between these side spaces for housing the contact operating mechanism. The mechanism and respective blocks are fitted respectively in a central groove 1*a* and long grooves 1*b* on its both sides of the base 1 which are forming respectively a part of these spaces. In the present instance, the cover 2 allowing only the operating member which comprises a handle of the contact operating mechanism to be projected out of the cover is fitted to the base 1 preferably by calked pins 3. On the outer bottom surface of the base 1 in which are exposed fitting ends of respective members including electric members for fitting the mechanisms and blocks to the base, in the present case, an insulative sheet or back plate 4 is adhered. The circuit breaker is installed by having this outer bottom surface contacted with a fitting surface of a distributor board or the like.

Figure 3:
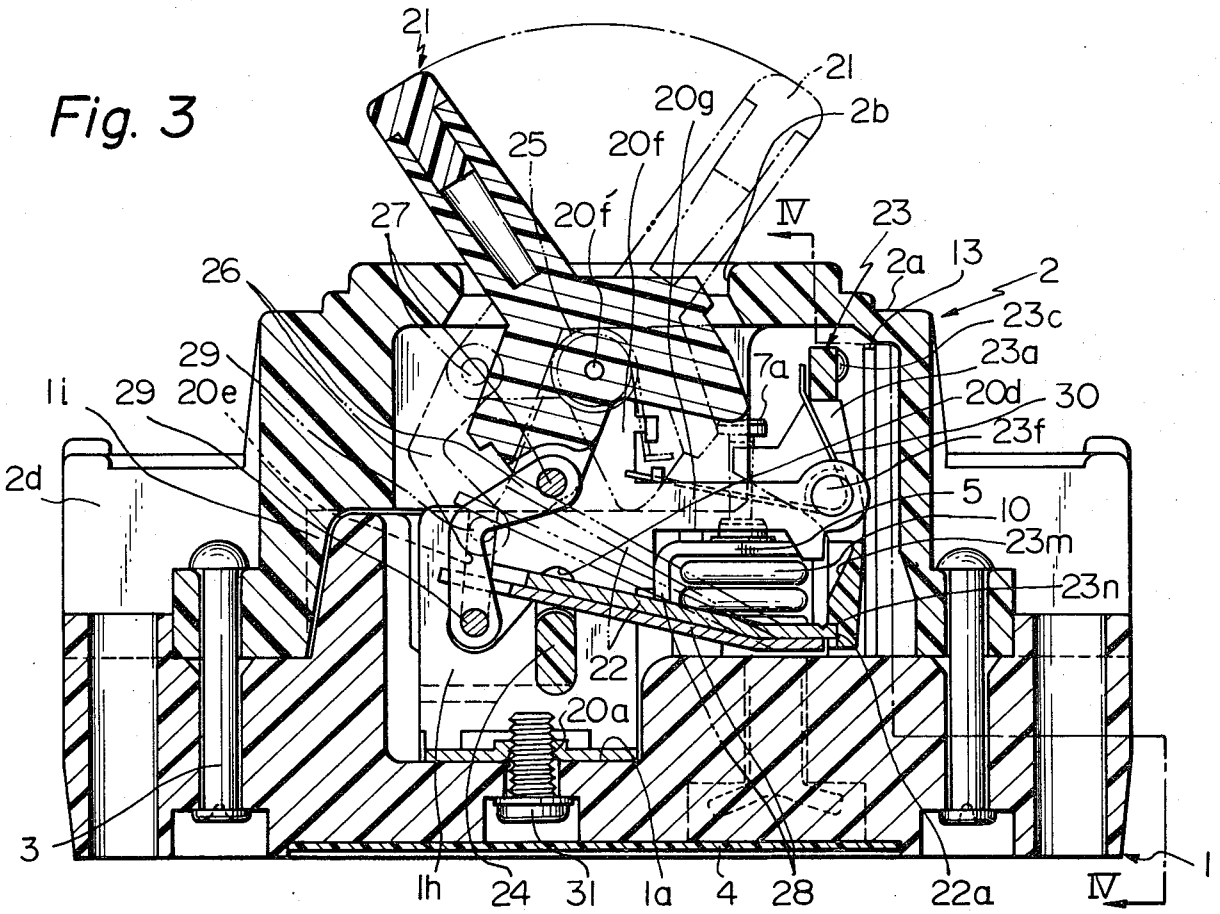
FIG. 3 is a vertically sectioned view mostly of a mechanical contact operating mechanism with the pole closed of the breaker shown along line III—III in FIG. 1.
Figure 4:
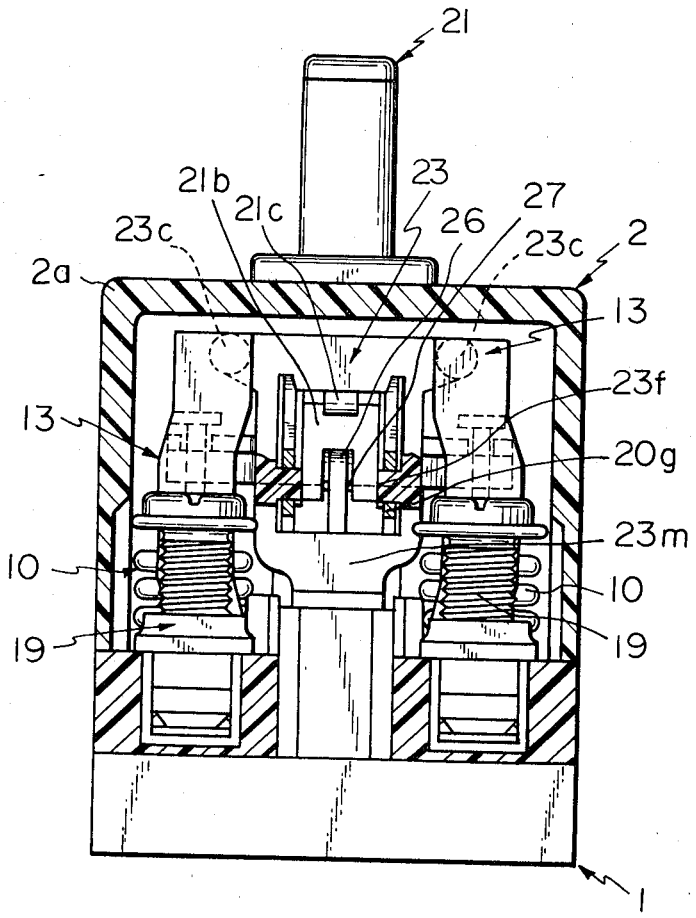
FIG. 4 is a horizontally sectioned view along line IV—IV in FIG. 3.
Figure 5:
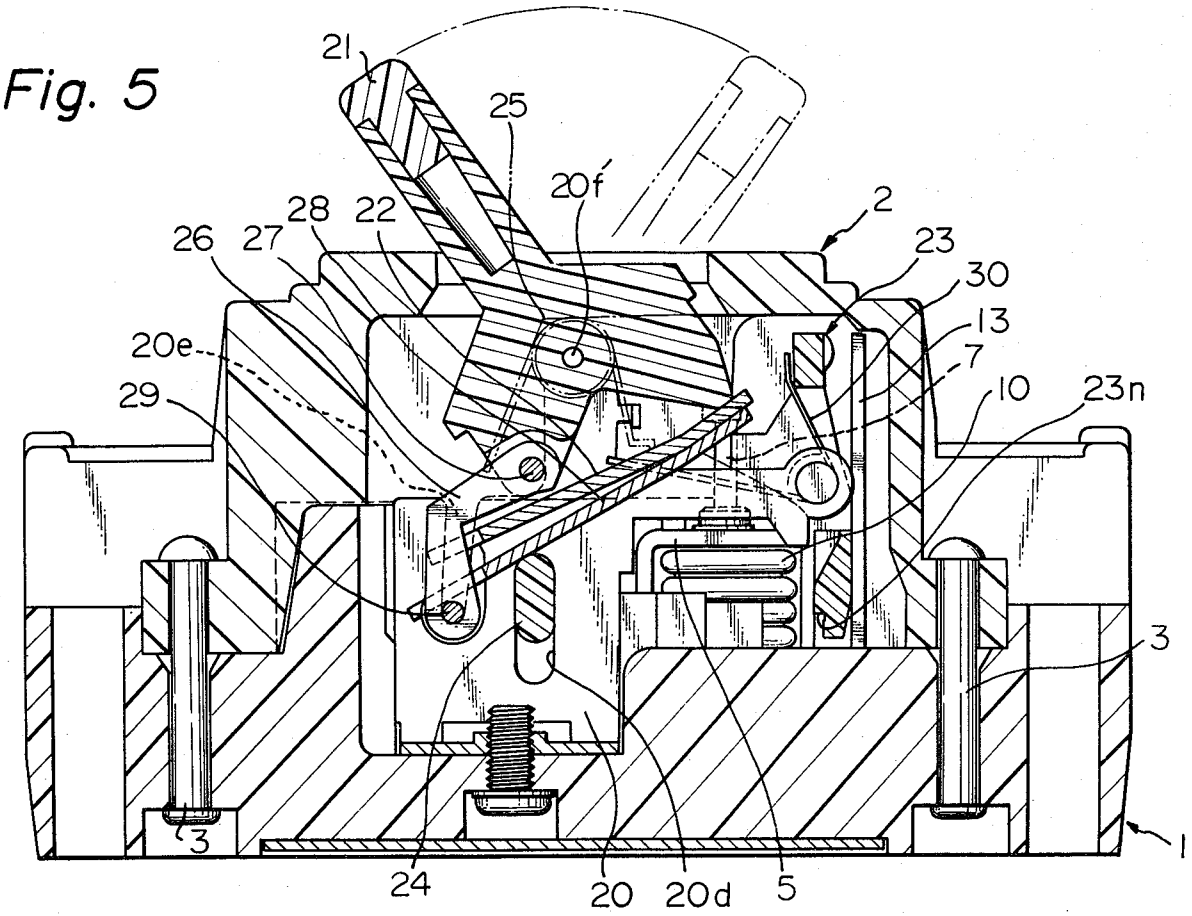
FIG. 5 is a vertically sectioned view similar to FIG. 3 but showing a step of tripping operation.
Figure 10:
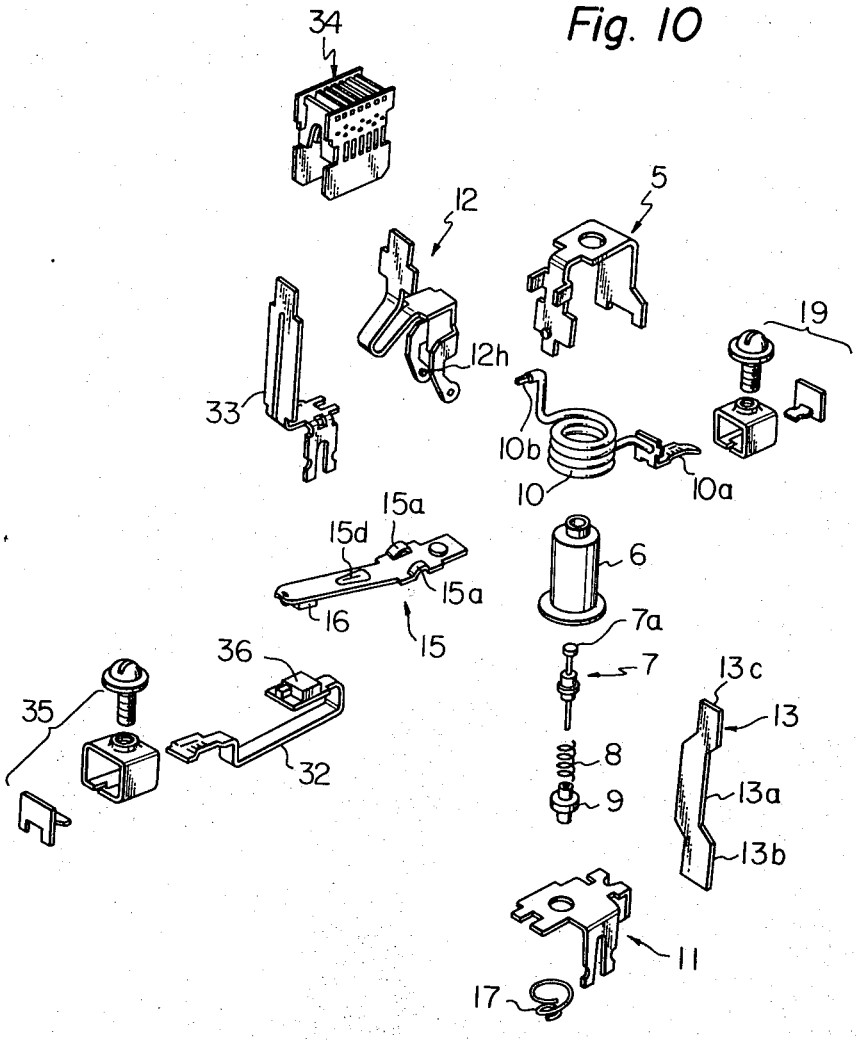
FIG. 10 is a perspective view as disassembled of one of the circuit breaking electric element blocks of the breaker in FIG. 1.

The two circuit breaking element blocks are respectively formed of such elements as shown in FIG. 10. As shown in FIG. 3, these elements form an electric path with the same arrangement disposed in the respective blocks, within each of the long grooves 1*b* and between a load side terminal 19 and a current source side terminal 35 fitted to longitudinal endwise opening parts of the respective long grooves 1*b* of the base 1. This electric path comprises a tripping means including a short-circuiting senser and overload current senser, the former of which consisting of a yoke 5 arranged on the side of each load side terminal 19, a cylinder member 6 arranged within the yoke, a plunger type movable iron core 7 coaxially arranged within the cylinder member 6, a fixed iron core 9 holding the movable iron core 7 through a coil spring 8 by passing one end of the iron core 7, a solenoid 10 arranged around the cylinder member 6 and connected at one end 10*a* to the terminal 19 and a yoke-fixing plate 11 holding the cylinder member 6 or solenoid 10 within the yoke 5 and fitted to the bottom surface of the long groove 1*b* of the base and the latter of which consisting of a bimetal 13 positioned at one end between the yoke-fixing plate 11 and the load side terminal 19 and secured to the fixing plate 11 as erected from the base substantially parallelly with the axial direction of the plunger 7 of the short-circuit senser while being connected at an intermediate portion to the other end 10*b* of the solenoid 10 through a twisted copper wire, a fixed contactor 32 arranged on the side of the current source side terminal 35 as connected at one end to the terminal 35 and carrying a fixed contact 36 at the other end which is once extended toward the load side terminal and then turned back toward the current source side terminal, and a movable contactor 15 extended between the fixed contactor and the short-circuit senser so as to oppose a movable contact 16 carried at one end to the fixed contact 36 and pivoted adjacent the other end to the yoke 5 which is a stationary part of the short-circuit senser as another aspect of the present invention. In the illustrated case, the movable contactor 15 is electrically connected to the securing end of the bimetal 13 through a twisted copper wire 18*c* at the other end extending over the pivoting point.

On the side of the source side terminal 35, there is also arranged an arc suppressing means, which comprises a first arc running plate 12 secured at one end to the yoke 5 of the short-circuit senser, extended intermediately once toward the movable contact, then turned back and extended at the other end in the upright direction with respect to the bottom surface of the long groove 1*b*, a second arc running plate 33 connected adjacent one end to the other end of the fixed contactor 32, extended similarly upright at the other end to oppose substantially parallelly to the other upright extended end of the first arc running plate 12, and an arc suppressing grid 34 holding a plurality of magnetic plates with their V-shaped incisions directed to the bottom surface of the long groove 1*b* of the base and parallelly opposed to each other through a gap, between the other opposed ends of the first and second arc running plates 12 and 33.

In this embodiment, the movable contactor 15 is pivoted by mounting semicircular bent parts 15*a* provided on both side edges of the contactor 15 on a pair of columnar projections 12*h* provided on the inner surfaces of a pair of opposed legs extended from the securing end of the first arc running plate 12 to the yoke 5. The movable contactor 15 is always biased on its side having the movable contact 16 in the direction of separating from the fixed contact 36 of the fixed contactor 32 by means of a compression coil spring 17 inserted between the other end extending toward the load side terminal 19 from the pivoting point 15*a* and the fixing plate 11 of the short-circuit senser. The lower end of the plunger 7 retracted always into the fixed iron core 9 of the short-circuit senser is opposed to the other extended end of the movable contactor 15.

Figure 8:
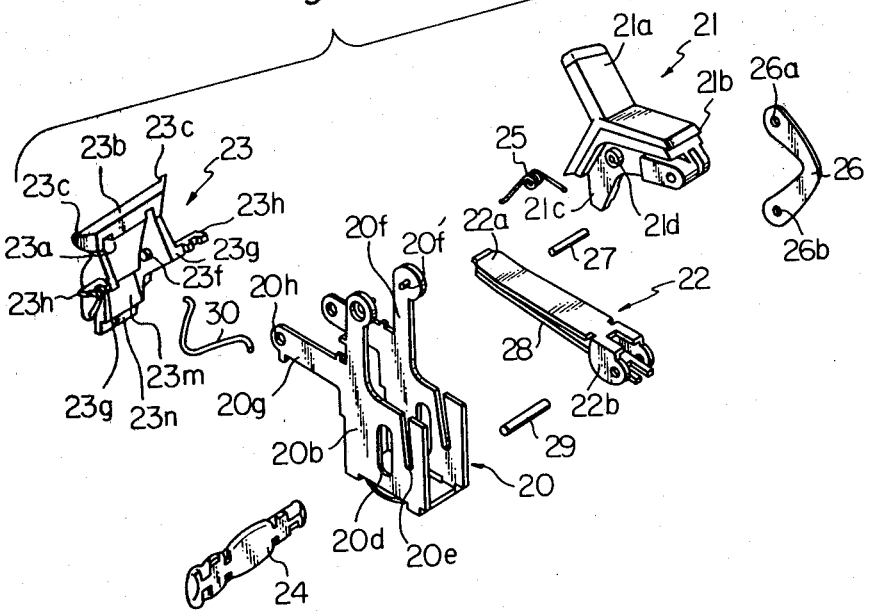
FIG. 8 is a perspective view as disassembled of the contact operating mechanism of the breaker of FIG. 1.
Figure 9:
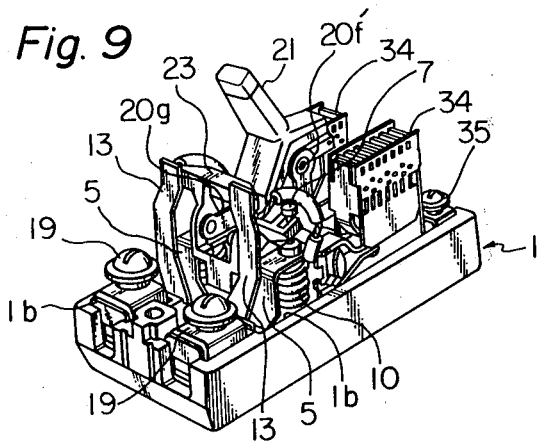
FIG. 9 is a perspective view as assembled of the breaker of FIG. 1 with the cover removed.

The contact operating mechanism arranged within the central groove 1*a* of the base 1 comprises respective members such as shown in FIG. 8, which are assembled as shown in FIG. 3 and are fitted to the bottom surface of the central groove 1*a*. A frame 20 for connecting and supporting the respective members and mounted to the bottom surface of the central groove 1*a* at a hole 20*a* provided in the bottom part is formed by bending a metal plate substantially to be V-shaped so as to have a pair of handle-supporting arms 20*f* extending upward from opposed leg parts 20*b* and a pair of tripping-plate-supporting arms 20*g* extending sideward. A handle 21 having three arms 21*a*, 21*b* and 21*c* extending in three separate directions substantial at equal intervals is supported by inserting pivoting shafts 20*f'* provided at opposing tips of the handle-supporting arms 20*f* of the frame into shaft holes 21*d* made between the arms 21*b* and 21*c* of the handle 21 together with a return biasing spring 25 through which one of the shafts 20*f'* is inserted to give to the handle a biasing force acting to the side of the arm 21*b*. The handle may be supported by inserting a shaft rod through the hole 21*d* instead of the pivoting shafts 20*f'*. This handle 21 is coupled to an engaging member 24 which is engaged in turn to the respective movable contactors in the both blocks as projected at both ends out of a pair of guide slits 20*d* provided in the opposed legs 20*b* of the frame 20, through a trip lever 22 made of an elongated metal plate mounted on the engaging member 24 and a link 26 of a substantially L-shaped metal plate connected at one end to the arm 21*b* of the handle 21 through a shaft pin 27 and at the other end to a bearing 22*b* made at one end of the lever 22 through a shaft pin 29 which projects in both endwise directions out of the bearing 22 of the trip lever 22 and movable inserted at the both projecting ends into a pair of other guide slits 20*e* provided to open upward in the opposed legs 20*b* of the frame 20 so that the connecting end of the lever 22 can shift up and down along the guide slits 20*e* with the rotation of the handle 21. The trip lever 22 is connected on the lower surface of the other end 22*a* with one end of an also elongated contact pressure spring plate 28 arranged so as to extend along the lever 22 on the side on which the lever engages the engaging member 24, while the particular end 22*a* of the lever 22 is made engageable at its tip with a step 23*n* made at a bar 23*m* of a rocking lower end of a tripping plate 23 which is mounted to the frame 20 rockably with the upper end lower ends about a pair of pins 23*f* projected inward substantially at the center of the plate 23 into a trip-lever-avoiding aperture 23*a* of the plate 23 and born in shaft bearing holes 20*h* made in both extended ends of the tripping-plate-supporting arms 20*g* of the frame 20. In this tripping plate 23, the rocking lower end is always biased in the direction of engaging with the other engaging end 22*a* of the trip lever 22 with a substantially L-shaped spring 30 engaged in the middle with the projecting pins 23*f* and at both ends with a bar 23*b* at the rocking upper end of the tripping plate 23 and with the tripping plate supporting arms 20*g* of the frame 20. Further, the frame-shaped tripping plate 23 formed to define therein the opening 23*a* is provided with side projections 23*c* projecting transversely into the long grooves 1*b* on both sides over the width of the central groove 1*a* of the base 1 from the bar 23*b* at the rocking upper end and engageably opposed to the upright extended end of the bimetal 13 of each circuit breaking element block, and with further side projections 23*h* projecting also into the both long grooves 1*b* over the tips of the respective upward extending parts 20*f* of the tripping-plate-supporting arms 20*g* of the frame 20 from the pivoting points of the substantially central projecting pins 23*f* so as to be engageable with a flange 7*a* provided at the upper end of the normally upward projecting plunger 7 of the short-circuit senser of the circuit breaking element block. When this block is provided, for example, only with the short-circuit senser as a tripping means, the tripping plate 23 may also be provided only with the latter projections 23*h* as the side projections of the rocking upper end.

Figure 2:
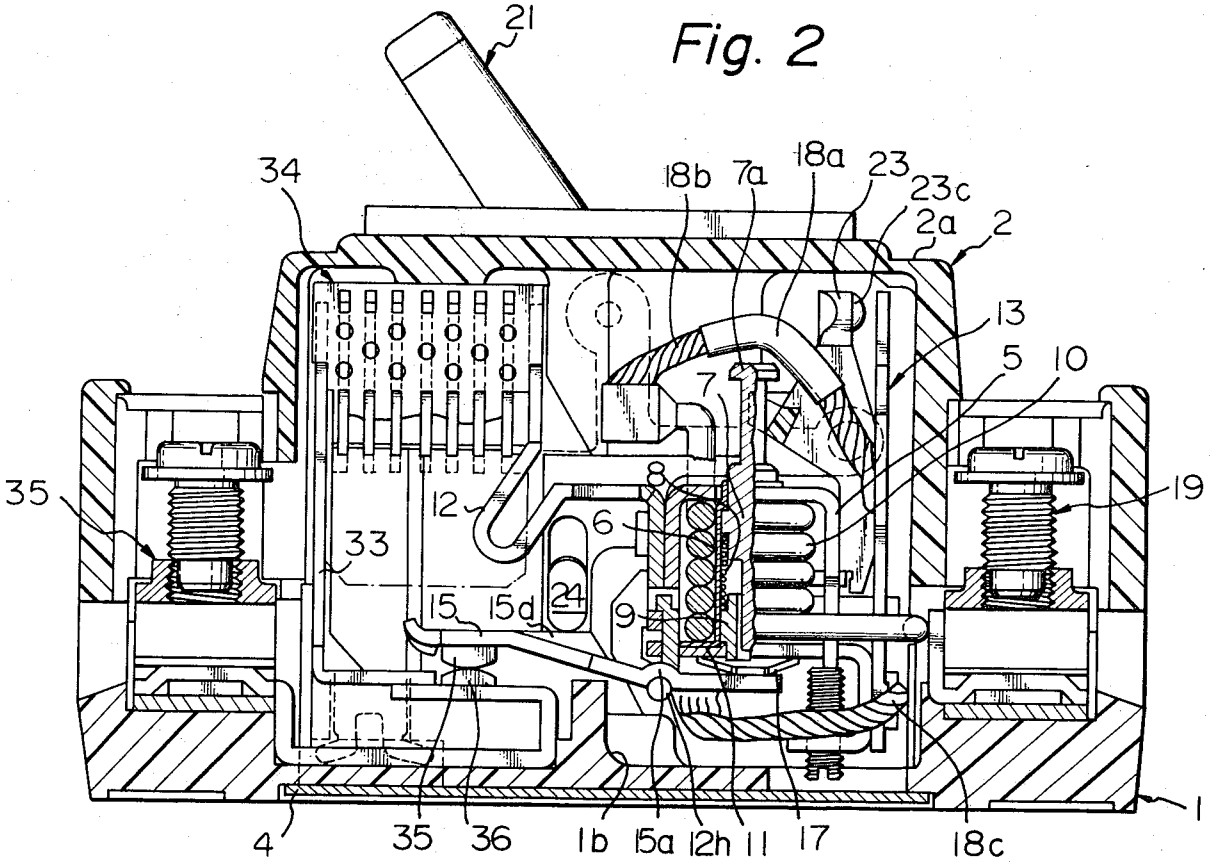
FIG. 2 is a side view mostly of a circuit breaking electric element block in the breaker of the present invention in a state of pole opening and shown partly in section along line II—II in FIG. 1.
Figure 11A:
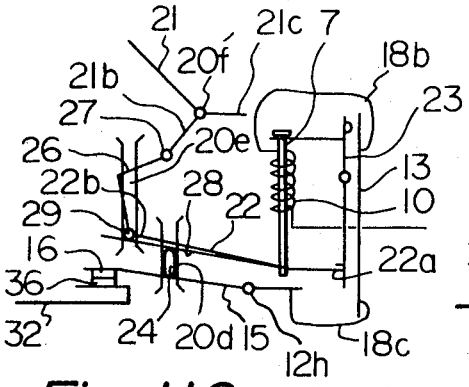
FIGS. 11A to 11E are explanatory views for schematically showing respectively the pole opening and closing operations and tripping operations of the breaker shown in FIG. 1.

The operation of the circuit breaker of the present invention shall be described with reference to FIGS. 11A to 11E, wherein FIG. 11A shows an ordinary pole closing state in which the respective elements of the circuit breaking element block are as in FIG. 2 and the respective elements of the contact operating mechanism are as in FIG. 3. In this state, the handle 21 is rotated to the pole closing or ON side on the left in the drawings, the pin 27 of the link 26 is thereby pushed downward to thereby push down the pin 29 through the guide slits 20*e* in the frame 20 and the trip lever 22 engaged with the tripping plate 23 at the engaging end 22*a* rotates with this end 22*a* as a fulcrum to depress the movable contactor 15 of the circuit breaking element block to the position of contacting the fixed contactor 32 through the engaging member 24 also urged down along the guide slits 20*d* of the frame. At this time, the link pin 27 comes onto a straight line connecting the handle supporting shaft 20*f'* and the link pin 29 in the lower position or slightly inside over the straight line, the resiliency of the spring 28 of the trip lever 22 giving to the movable contactor a contact pressure through the engaging member 24 and the resiliency of the spring 17 always biasing the movable contactor in the pole opening direction will be substantially linearly transmitted to the handle supporting shaft 20f' through the link pins 27 and 29, whereby the link 26 is locked in this state and the both contacts remain closed.

Figure 6:
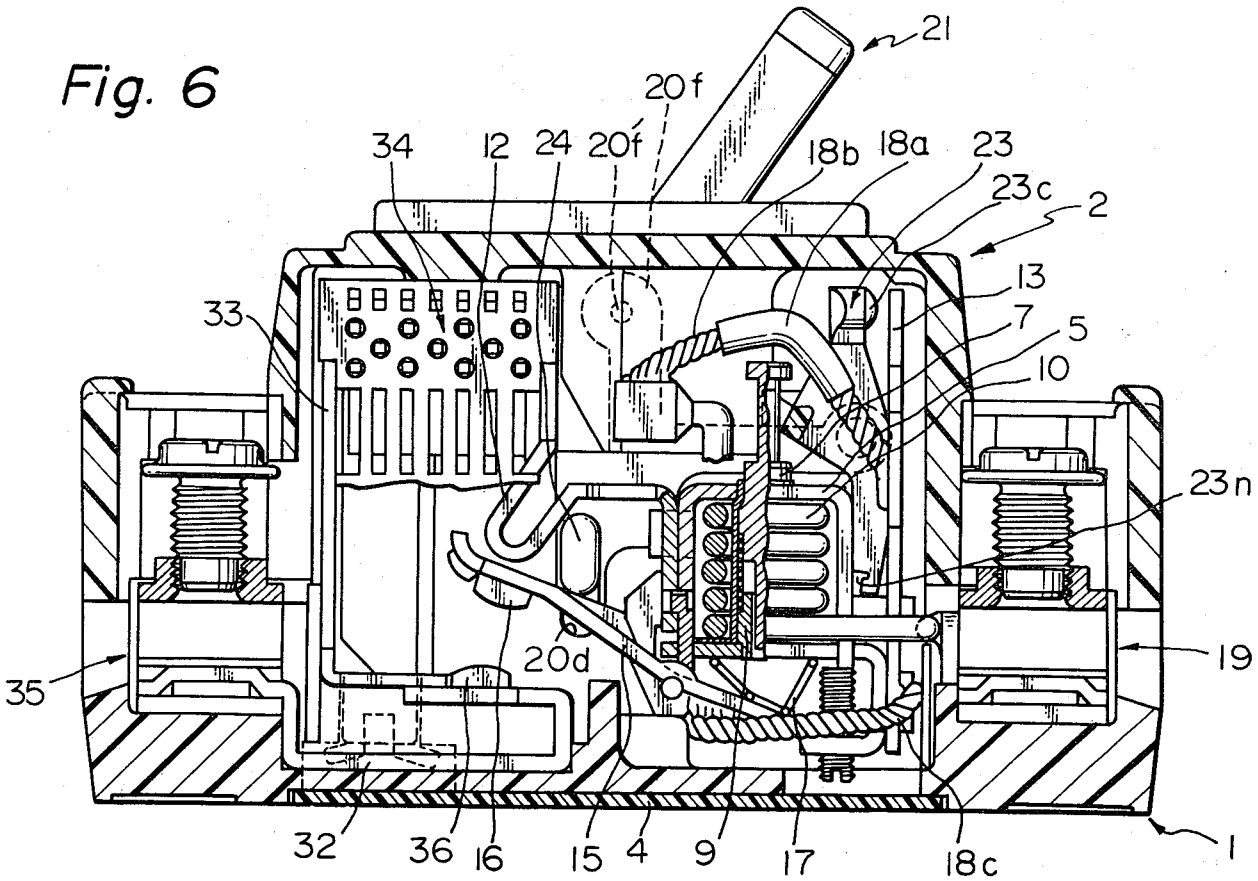
FIG. 6 is a side view similar to FIG. 2 but with the pole opened.
Figure 7:
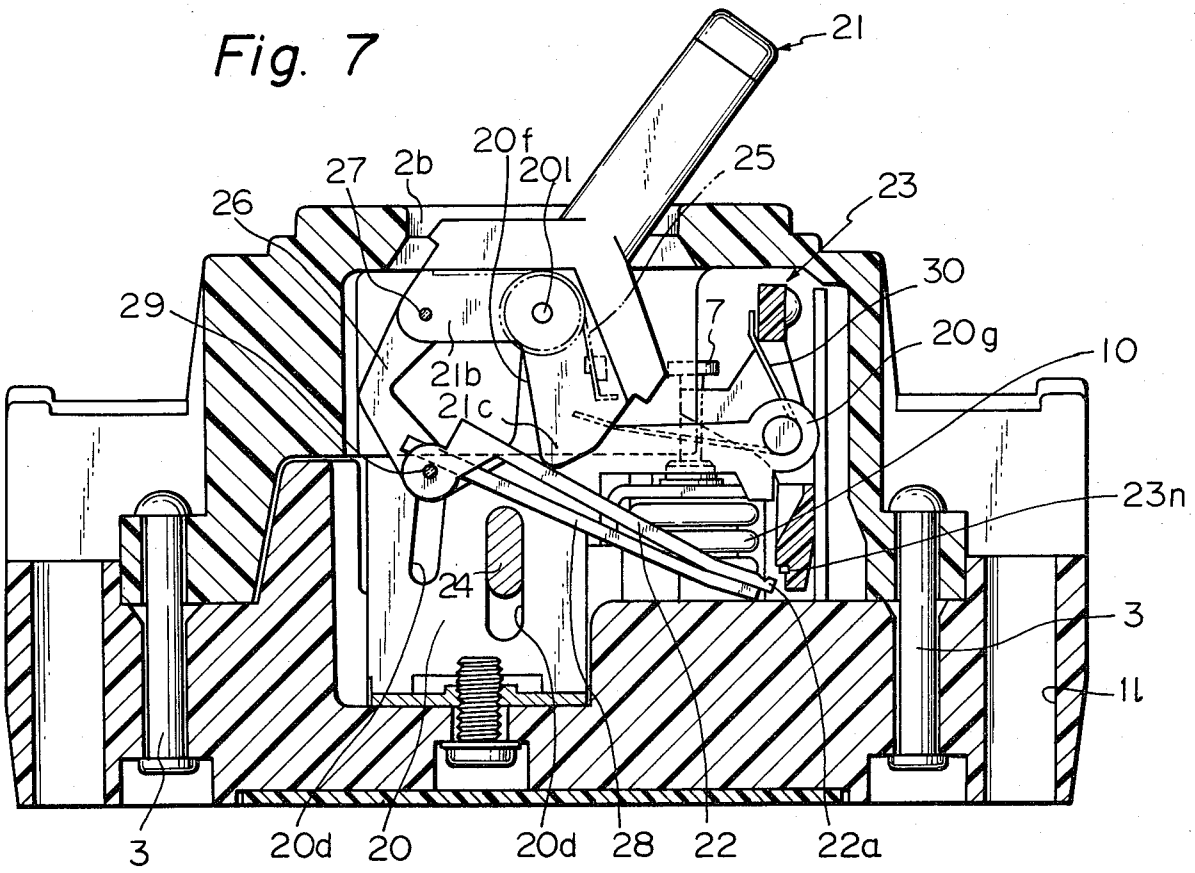
FIG. 7 is a vertically sectioned view similar to FIG. 3 but with the pole opened.
Figure 11B:
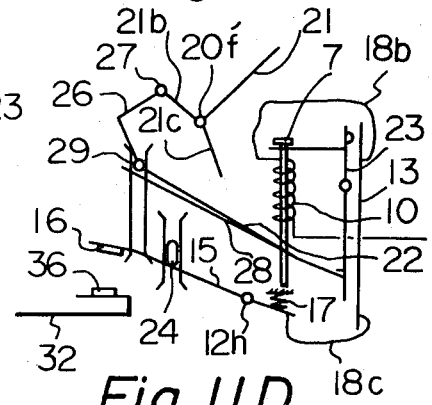

FIG. 11B is a view showing an ordinary pole opening state and corresponding to FIGS. 6 and 7. When the handle 21 is rotated clockwise in the drawings, the link pin 27 moves to the left of the foregoing straight line, thereby the locking is released and the biasing force of the spring 17 pushes up the movable contactor 15, engaging member 24 and trip lever 22.

Figure 11C:
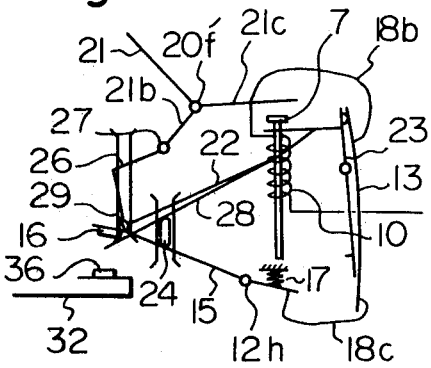

FIG. 11C shows a tripped state at the time of responding to an overload current wherein the bimetal 23 is caused to be bent by a heat due to the overload current so as to engage and rock the tripping plate 23, the engagement of the tripping plate 23 with the trip lever 22 is released, the lever 22 is thereby rotated due to the resiliency of the spring 28 about the engaging member 24 as a fulcrum and the depression on the engaging member 24 and movable contactor 15 is thereby released. At this time, the contact operating mechanism is in the state shown in FIG. 5, in which the resiliencies of the springs 17 and 28 in the case of FIG. 11A are not given to the link pin 29, so that the spring 25 biasing the handle 21 in the pole opening direction will be activated, the link pin 27 will move to the outside the foregoing straight line, the handle 21 will return to the pole opening or OFF position, the link pin 29 will be pulled up, the trip lever 22 will rotate with the engaging member 24 as a fulcrum, the engaging end 22a of the trip lever will again engage the tripping plate 23 returning to be normal together with the bimetal returned to be normal by natural cooling after the overcurrent is eliminated due to the pole opening, and thus a resetting operation will be automatically completed.

Figure 11D:
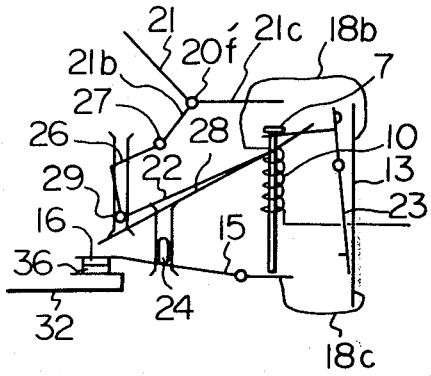
Figure 11E:
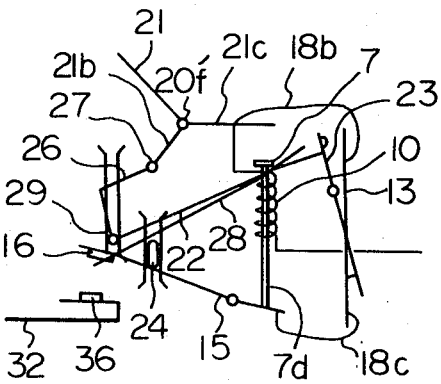

FIGS. 11D and 11E show the tripping operation when the short-circuit senser responds to a short-circuited current, wherein FIG. 11D shows its initial state and FIG. 11D shows the opened pole state due to the tripping. When the solenoid 10 is excited by a short-circuited overcurrent, the plunger 7 will be magnetically attracted to shift downward in the drawings, its upper end flange 7a will engage and pull down the side projection 23h of the tripping plate 23, the tripping plate 23 will rock to disengage with the trip lever 22 and the same state as in the case of FIG. 11C will be achieved. When the plunger 7 is further attracted, the lower end of the plunger pushes the extended end of the movable contactor 15 to urge it to rotate in the direction of the biasing force of the spring 17, the movable contactor 15 will be thereby forced to shift to the pole opening position and the circuit will be thus broken. From this state, the automatic resetting operation described with reference to FIG. 11C will be attained in the same manner and the contact operating mechanism will also be returned to be OFF.

The operation of the arc suppressing means used in the above described embodiment to suppress the arc generated between the fixed contact and movable contact at the time of the pole opening operation of the movable contactor or particularly in the case of that operation due to the tripping responsive to the short-circuited current is substantially identical with that of the ordinary, so-called current limiting type arc suppressing means whereby the arc is magnetically driven within an arc suppressing grid along the arc running plates to be divided in many grid gaps so as to be suppressed, and its detailed explanation shall be omitted here. Briefly stating the operation in the illustrated embodiment, the arc generated between the opened contacts on the side of the source side terminal 35 is magnetically driven initially along the second arc running plate 33 then vertically upward into the grid as expanded between the first and second arc running plates 12 and 33 to be suppressed within the grid 34. Arc gas thus exhausted from the grid vertically upward hits the inner surface of the cover 2 to be divided into both sideward directions by a rib provided on the inner surface of the cover so as to be caused to flow down toward the base 1 along respective insulative grid-supporting plates extending between the arc running plates 12 and 33 and is then exhausted out of the housing through a side wall aperture of the base 1 communicating with its opening above the source side terminal 35 as sufficiently cooled and in a direction irrespective of a wiring cord connected to the particular terminal.

Figure 12:
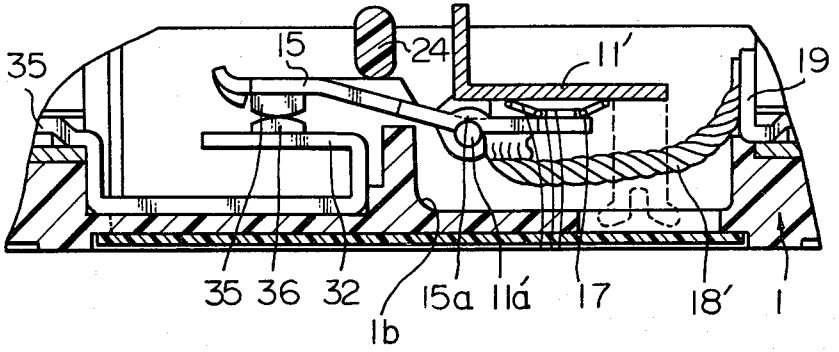
FIG. 12 is a fragmental vertically sectioned view showing another embodiment of the present invention.

FIG. 12 shows another embodiment of the present invention, wherein the electric path between the both terminals in one of the side spaces is formed of the circuit breaking element block of such arrangement as has been described in the foregoings, whereas the electric path in the other side space is made to be of a simpler arrangement. In the present case, the tripping and arc suppressing means are omitted, the movable contactor 15 is pivoted by pins 11'a provided on a fixed plate 11' which substantially corresponds to the yoke fixing plate 11 of the short-circuit senser in the foregoing embodiment, and the same spring 17 biases the thus pivoted contactor 15 toward the normally opened position while the contactor 15 is caused to engage the engaging member 24 of the operating mechanism so as to perform the same operations as in the before described pole opening and closing operations. The electric connection of the movable contactor 15 with the load side terminal is performed by means of a twisted copper wire 18' connected at its one end to the movable contactor and at the other end directly to a connector plate of the terminal 19.

While not shown, a simpler arrangement is obtainable when a flexible movable contactor is directly fixed to the bottom of the long groove 1b in the base 1 at one end opposite to the movable contact and a spring is inserted between the bottom and the movable contactor to provide to the contactor the pole opening biasing force. That is, it may suffice that any basic means for electrically connecting the source to the load without any overcurrent responsive tripping means is housed in one of the side spaces and, at the simplest arrangement, the both terminals 19 and 35 may be connected by the same cord as that externally connected to these terminals or even the cord may be simply housed in the side space omitting the both terminals.

The tripping means in the circuit breaking element block may comprise, as desired, only either one of such electromagnetically responsive short-circuited current senser and thermally responsive overload current senser as has been described. Further as desired, the dash-pot type electromagnetically responsive senser may be employed as the tripping means of an intermediate performance between these two sensers with respect to the both short-circuited and overload currents. In this case, the pivoting of the movable contactor is performed by movably engaging the load-side-terminal side end of the movable contactor to a vertical part of the yoke fixing plate 11 as in, for example, FIG. 3 while electrically connecting between them and providing to the contactor the normally pole opening biasing by means of a compressive spring inserted between the contactor and the long groove bottom or a tensile spring hung between the contactor and a part of the yoke 5, at a position remove from the engaging end. Further in this case, the tripping plate 23 may be omitted.

While the foregoing embodiments have been described with reference to the breaker of the type manually performing the ON and OFF operations with the handle rotatable about a fixed shaft, the ON and OFF operating means may not be limited to such handle, such means as a push-button shiftable vertically with respect to the base bottom. In this case, the link pin 27 for the link 26 in the foregoing embodiment may be fixed to, for example, the link 26, a connecting part of the push-button to the pin 27 may be provided with a guide groove for allowing the pin 27 to slide between such two positions of the pin as shown in FIG. 3 with solid and chain lines responsive to the button shiftings and to be capable of maintaining the solid line position as in FIG. 3 of the pin 27 upon the operations of FIGS. 11A and 11C, and then the link 26 and trip lever 22 as well as their relative arrangement as has been set forth may be employed as they stand. So long as the same operations can be achieved, further, the ON and OFF operating means may be of a rotary type which is employed in limit switches or the like.

According to the present invention, as has been disclosed, the circuit breaker housing provided with the two side spaces for use with the two poles and respectively capable of housing each circuit breaking element block is further provided with one intermediate space between the side spaces, and the single contact operating mechanism which is commonly operably coupled to the two circuit breaking element blocks is housed in the intermediate space as separated from the blocks, so that either one of these blocks does not require to have the contact operating mechanism or any one of its component parts, the number of parts can be reduced to a large extent to reduce necessary resources and costs, the structure can be simplified to render assembling works easier, and the required minimization of size can be made possible without restricting the capacity of the device. Since the mechanical contact operating mechanism and electrical circuit breaking element blocks are accommodated in a common housing as separated from each other, no electrical and thermal influence will be imposed on the mechanism. As the respectively divided spaces in the housing can be sufficiently utilized in arranging the mechanism and blocks, a structure which is performable sufficient functions of the respective mechanism and block can be properly selected, and highly reliable circuit breaking characteristics are well achievable. Specifically in the circuit breaking element block, the overcurrent responsive tripping means and arc suppressing means can be disposed in the side space as separated from each other in the longitudinal direction of the space, so that any influence due to the arc generated on the tripping means can be restricted to be minimum and improved circuit breaking characteristics can be maintained stably for a long time. Since the tripping means electromagnetically responsive to the overcurrent is so disposed, further, that the axis of the movable core which performs the tripping operation of the movable contactor as axially moved upon the solenoid excitation will be vertical with respect to the housing bottom or the external fitting surface of the breaker, the vertical disposition of the movable core is not to be varied in any of various fitting postures of the breaker on the fitting surface so long as the latter is not changed, so that the operational current value of the movable core will never fluctuate due to any fluctuation in the gravity and the stable circuit breaking characteristics can be always obtained.

What is claimed is:

1. A circuit breaker comprising a housing consisting of a base to be fitted to an external fitting surface and a cover fixed onto said base; a circuit breaking electric element block including current source side and load side terminals fixed respectively at both opposed end positions of said base, a fixed contactor carrying a fixed contact and connected to said current source side terminal, a movable contactor carrying a movable contact contactable with said fixed contact and connected to said load side terminal, said movable contactor being normally biased in a noncontacting direction, and a tripping means inserted between the movable contactor and the load side terminal and at least electromagnetically operating in response to an overcurrent to forcibly trip the contact of the movable contactor with the fixed contactor; and a mechanical contact operating mechanism moving the movable contactor between the positions of contact and noncontact with the fixed contactor with an external operating force given through an operating member projecting out of said cover and operatively connected to the tripping operation of said tripping means, wherein said housing being provided with a pair of side spaces extending substantially in parallel to each other and with an intermediate space provided between said side spaces, at least one of said circuit breaking element block being contained in at least one of the side spaces, said single contact operating mechanism being contained in said intermediate space and operatably engaged with said movable contactor and tripping means of the circuit breaking element block with an operating means extending into the side spaces, and said movable contactor being movably supported by a stationary part of the tripping means and electrically separated from the operating mechanism.

2. A circuit breaker according to claim 1 wherein a single of said circuit breaking element block is housed in one of said side spaces of said housing, and a member for connecting a current source and a load is housed in the other side space.

3. A circuit breaker according to claim 1 wherein two of said circuit breaking element blocks are housed respectively in each of said pair of side spaces of said housing; said movable contactor is an elongated member extending substantially in the longitudinal direction of each of the side spaces, said elongated member being pivoted adjacent one end on the side of said load side terminal and having the other end carrying said movable contact opposed to said fixed contactor on the side of said current source side terminal; said contact operating mechanism includes a lever member extending in the longitudinal direction of said intermediate space of the housing and connected to said operating member at one end through a link member; said operating means of the contact operating mechanism comprises an engaging member extending into both side spaces across the intermediate space and engaging substantially in the middle with said lever member on the side in the moving direction of the operating member and lever member accompanying said external operating force and at both ends with the movable contactor within both side spaces at the position of the contactor between said pivoting position and the other end, and a tripping member rockably pivoted substantially in the center on the other end side of the lever member and extending at one rocking end engageably with the other end of the lever member and at the other end in the sideward direction within both side spaces across the intermediate space, said tripping member being engageable with a movable member provided in said tripping means of respective said circuit breaking element blocks at respective sideward extended ends and being biased so that normally said one rocking end engages said other end of the lever member to provide a rotary fulcrum to the lever member; whereby the lever member is caused to rotate with said other end as a fulcrum in response to an application of said operating force, the engaging member depresses at both ends the respective movable contactors in response to said rotation to move them to said contact positions, said link member locks the lever member and engaging member as in the contact positions in the final period of the rotation of the lever member and, on the other hand, the movable member of the tripping means engages at least one of both ends on the other rocking end side of the tripping member to release the engagement of the lever member with the tripping member as well as said locking of the lever member and engaging member with the link member so as to move the movable contactor to said noncontact position.

4. A circuit breaker according to claim 3 wherein said operating member of said contact operating mechanism is a handle rotatably supported on a supporting shaft transversing said intermediate space of said housing, said link member is connected at both ends rotatably between one end of said handle and one end of said lever member, said external operating force rotating the handle to said one end side of the lever member locks the lever member and engaging member in the state at the time of said contact position of said movable contactor but a release of the engagement with the lever member at said one rocking end of said tripping member accompanying the operation of the tripping means rotates the lever member with its connecting point to the link member as a fulcrum in said locked state of the lever member and engaging member, and thereby the pressing force given to the movable contactor through the engaging member is released.

5. A circuit breaker according to claim 3 wherein said tripping means is a plunger type short-circuit senser comprising a solenoid supported by a yoke forming said stationary part as erected with the axis on the bottom surface, a fixed iron core arranged coaxially within said solenoid and a plunger forming said movable member, one end of said plunger normally retracted in said fixed core being engageably opposed to an end of said movable contactor extending over said pivoting position toward said load side terminal and the other end normally projected being engageably opposed to each of said both sideward ends of said the other rocking end of said tripping member of said contact operating mechanism so that, with the movement of the plunger responsive to the short-circuited overcurrent, said one end of the plunger urges the movable contactor to separate from the fixed contactor and the other end engages the other rocking end of the tripping member to rock the same so as to release the engagement of the tripping member with the lever member.

6. A circuit breaker according to claim 5 wherein said movable contactor is biased in the direction toward said noncontact position by a spring provided between said extended end of the movable contactor and said yoke, and said lever member of said contact operating mechanism is provided with a spring inserted between the member and the engaging member to give to the movable contactor a contact pressure with the fixed contactor.

7. A circuit breaker according to claim 5 wherein said tripping means further comprises a bimetal type overload current senser inserted in said electric path between said short-circuit senser and said movable contactor, said tripping member of said contact operating mechanism has a pair of arms extending into respective said side spaces of said housing substantially on the same side as of said the other rocking end with respect to said pivoting position, and said bimetal senser is fixed at one end to the housing to be upright so as to oppose at the other end engageably to each of said arms of the tripping member so that the other end of the bimetal senser will contact the arm of the tripping member when curved as heated due to an overload current to cause the tripping member rocked to release said engagement with said lever member.

8. A circuit breaker according to claim 7 wherein said overload current senser is disposed between said plunger type short-circuit senser and said load side terminal.

9. A circuit breaker according to claim 1 wherein tripping means comprises a solenoid supported by a yoke which forming said stationary part as inserted in said electric path between said load side terminal and said movable contactor, said solenoid being erected with the axis with respect to the bottom surface of said base, and a dash-pot type iron core disposed coaxially within the solenoid, the movable contactor comprises a conductive and magnetic material and is resiliently biased in the direction toward said noncontact position on the side carrying said movable contact with respect to said pivoting position, and the head of said iron core which attracting a movable core inside said iron core upon an excitation by an overcurrent is opposed to the movable contactor on its side having said movable contact and in its moving direction toward the noncontact position.

10. A circuit breaker according to claim 1 wherein said movable contactor is disposed to position one end carrying said movable contact on the side of said current source side terminal and extends substantially along the bottom surface of respective said side spaces of said housing, said tripping means comprises a solenoid to be excited by an overcurrent, a fixed and movable iron core assembly arranged coaxially with said solenoid, and a yoke supporting said solenoid and iron core assembly so that their axes are erected on the bottom surface of the housing and forming said stationary part pivoting the movable contact, said tripping means being fixed within the side space on the side of said load side terminal and at a position where said movable iron core electromagnetically operated by the solenoid excitation by the overcurrent causes the movable contactor to be tripped from said contact position, the fixed contactor is further extended substantially in the same direction as the movable-contact carrying end of the movable contactor by turning the extended end carrying the fixed contact from the direction of the load side terminal to the direction toward the current source side terminal, and an arc suppressing means which comprises a pair of arc running plates connected at their ends respectively to said turned back extended end of the fixed contactor and to the yoke of the tripping means and extended at the other ends in the direction substantially upright from the base bottom surface over both fixed and movable contacts so as to be opposed substantially parallelly with each other in the longitudinal direction of the side space and an arc suppressing grid fitted by directing its terminating end to the inner wall surface of the housing between the extended opposed ends of said arc running plates is provided on the side of the current source side terminal within the side space.

* * * * *